US005970877A

United States Patent [19]

Hensler

[11] Patent Number: 5,970,877

[45] Date of Patent: Oct. 26, 1999

[54] GUN PROPELLANT COATING

[76] Inventor: Jerry Hensler, 6614 Country Field, San Antonio, Tex. 78240

[21] Appl. No.: 09/033,059

[22] Filed: Mar. 2, 1998

[51] Int. Cl.[6] ..... C06D 5/06; C06B 45/14

[52] U.S. Cl. ..... 102/288; 102/289; 102/290; 102/511; 149/15; 149/20

[58] Field of Search ..... 102/288, 289, 102/290, 511; 149/20, 15

[56] References Cited

U.S. PATENT DOCUMENTS

| | | | |
|---|---|---|---|
| 2,299,465 | 10/1942 | Coffman | 102/39 |
| 3,730,094 | 5/1973 | Quinlan | 102/38 |
| 3,947,300 | 3/1976 | Passauer et al. | 149/35 |
| 4,203,264 | 5/1980 | Dobbs | 102/38 |
| 4,203,787 | 5/1980 | Kirchoff et al. | 149/35 |
| 4,735,146 | 4/1988 | Wallace | 102/511 |
| 4,759,885 | 7/1988 | Kurtz | 102/431 X |
| 4,858,534 | 8/1989 | Wallace | 102/511 |
| 4,979,999 | 12/1990 | Briére | 149/6 |
| 5,387,296 | 2/1995 | Taylor et al. | 149/35 |
| 5,421,263 | 6/1995 | Ruohonen | 102/435 |
| 5,725,699 | 3/1998 | Hinshaw et al. | 145/45 X |
| 5,735,118 | 4/1998 | Hinshaw et al. | 145/45 X |

*Primary Examiner*—Peter A. Nelson
*Attorney, Agent, or Firm*—Joseph F. Long

[57] ABSTRACT

A coating for a gun propellant powder wherein the graphite commonly used to coat a gun propellant powder is totally or partially replaced with molybdenum disulfide in an amount equal to or less than five tenths percent by weight of the propellant powder.

5 Claims, No Drawings

GUN PROPELLANT COATING

BACKGROUND OF THE INVENTION

Bench rest shooters have found that when shooting in competition with the normal uncoated bullet and the normal uncoated barrel that the rifle bore must be cleaned after about ten to twenty shots in order to maintain accuracy in a high powered rifle. A photomicrograph of the bore of a rifle indicates that the visually smooth bore is actually comprised of peaks and valleys with the peaks being more than twenty microns apart. When a cartridge in a high powered rifle is fired chamber pressures build to 35000 to 55000 pounds per square inch or more and a bullet is accelerated from a dead stop to 2500 to as much as 4000 feet per second or more. Bore fouling that occurs comprises bits of copper, and graphite from the normal powder coating. The graphite hardens and becomes abrasive under firing conditions and builds up in the rifle bore to finally score and deform the bullet to cause bullet unbalance and flight path deviation. Testing has shown that with a molybdenum disulfide coated powder this fouling is minimized because the first bullets fired coat the bore of the rifle. This happens because of the peculiar properties of molybdenum disulfide wherein under heat and pressure the laminar plates of the compound slide, much like a deck of cards. Electron photomicrographs have indicated that the sliding plates of the molybdenum disulfide bridge and smooth the photomicrographically rough rifle bore surface. Excess molybdenum disulfide is ejected from the rifle bore.

Most gun propellant powders are coated with graphite. The object of the present invention is to partially or totally replace the graphite coating of the propellant with molybdenum disulfide. Total replacement of the graphite is preferred. With this partial or total replacement and with either normal or molybdenum disulfide coated bullets the shooter will be able to fire many times without the necessity for cleaning the rifle bore as frequently and the gun should fire more accurately for increased number of shots.

Much prior art has been found wherein a bullet in a cartridge has been molybdenum disulfide coated to provide some of the benefits to the shooter as the subject invention. No prior art has been found wherein a gun propellant powder is coated with molybdenum disulfide. In Taylor, U.S. Pat. No. 5,387,296 up to 4% molybdenum disulfide is used as a binder and pressing aid for molding gas generant pyrotechnic compositions especially suitable for inflating vehicle occupant restraint systems. Taylor would indicate that coating of a gun propellant powder with molybdenum disulfide in place of graphite is feasible in gun propellant manufacture.

SUMMARY OF THE INVENTION

The invention comprises coating of a gun propellant powder with molybdenum disulfide to partially or totally replace the normal graphite coating. In use under firing conditions with graphite coating only traces of graphite in a gun barrel become hardened and erosive.

Molybdenum disulfide coating of bullets only has been shown to impede fouling and reduce the necessity for frequent cleaning.

Excess molybdenum disulfide is ejected out of the gun bore with use. Removal of part or all of the graphite on gun propellant powder and replacement with up to 5% by weight of the gun propellant powder with molybdenum disulfide will reduce fouling, reduce necessity for cleaning to maintain increased accuracy and greatly extend the useful life of a gun barrel.

DETAILED DESCRIPTION OF THE INVENTION

The invention comprises total or partial replacement of graphite in gun propellant powders with molybdenum disulfide. The molybdenum disulfide may mixed with the powder or in some other manner evenly distributed within the powder mass to coat the powder grains. The ultrafine molybdenum disulfide which may be particles from 20 to 480 plus microns in diameter is preferred. The preferred quantity of molybdenum disulfide is about 0.3% by weight of the propellant powder but quantities from 0.1% to 0.5% or greater should work equally well since the excess molybdenum disulfide is ejected from the gun bore. Because of the properties of the molybdenum disulfide most any method of bringing the disulfide into intimate contact with the powder should result in sufficient coating of the propellant to continuously recoat the gun bore in use.

What is claimed is:

1. A coating for a gun propellant powder comprising molybdenum disulfide in an amount equal to less than five tenths of one percent by weight of said gun propellant powder.

2. A coating for a gun propellant powder with said coating being ultra fine molybdenum disulfide in an amount of approximately three tenths percent by weight of said powder with said molybdenum disulfide being intimately mixed with said powder.

3. A coating for a gun propellant powder as in claim 2 wherein said ultra fine molybdenum disulfide has a particle size of twenty to eighty microns.

4. A coating for a gun propellant powder as in claim 2 wherein said ultra fine molybdenum disulfide has a particle size of twenty to four hundred and eighty microns.

5. A coating for a gun propellant powder comprising both graphite in an amount equal to less than five tenths of one percent by weight of said gun propellant powder and molybdenum disulfide in an amount equal to less than five tenths of one percent by weight of said gun propellant powder.

* * * * *